United States Patent [19]

Richardson

[11] Patent Number: 4,952,090

[45] Date of Patent: Aug. 28, 1990

[54] APPARATUS FOR DISPENSING A SCENTED FLUID

[76] Inventor: Aubrey W. Richardson, P.O. Box 524, Oregon City, Oreg. 97045

[21] Appl. No.: 290,649

[22] Filed: Dec. 27, 1988

[51] Int. Cl.[5] ..... B43M 11/02

[52] U.S. Cl. ..... 401/209; 401/209

[58] Field of Search ..... 401/115, 131–135, 401/208, 209, 214, 216, 219, 220, 217, 274; 222/454–456, 463

[56] References Cited

U.S. PATENT DOCUMENTS

| | | | |
|---|---|---|---|
| 14,641 | 4/1856 | Priestly | 222/463 |
| 849,513 | 4/1907 | Sturm | 401/216 X |
| 1,670,458 | 5/1928 | Le Boeuf . | |
| 1,714,030 | 6/1928 | Le Boeuf . | |
| 1,977,414 | 10/1934 | Testa . | |
| 2,122,580 | 7/1938 | Morris . | |
| 2,229,749 | 1/1941 | Little | 401/135 |
| 2,378,312 | 6/1945 | Madigan | 222/463 X |
| 2,487,340 | 11/1949 | Kleinsmith | 401/216 |
| 2,663,891 | 12/1953 | Hanryon . | |
| 2,719,314 | 10/1955 | Taube . | |
| 2,913,153 | 11/1959 | Hester, Jr. | 222/463 |
| 4,572,691 | 2/1986 | Kirchhoff et al. | 401/214 |

*Primary Examiner*—Richard J. Apley
*Assistant Examiner*—D. F. Crosby
*Attorney, Agent, or Firm*—Marger & Johnson, Inc.

[57] ABSTRACT

A dispenser for cologne or the like. The dispenser includes an elongate case having a body and a cap which includes a clip for carrying the dispenser in a shirt pocket. The case includes a reservoir for holding cologne or the like and a roller-ball applicator. A plug having a bore therethrough which is at an angle relative to the longitudinal case axis permits flow of cologne from the vial to the roller-ball applicator when the dispenser is tipped. When the dispenser is placed in a horizontal position, cologne cannot flow through the plug bore due to the angle of the bore, thus preventing cologne in the vial from reaching the applicator.

20 Claims, 3 Drawing Sheets

APPARATUS FOR DISPENSING A SCENTED FLUID

BACKGROUND OF THE INVENTION

1. Field of the Invention

The present invention relates to dispensers for cologne or the like and more particularly to such dispensers which include a roller-ball applicator.

2. Description of the Related Art

Perfume dispensers of the type having a roller-ball applicator are known in the prior art. Such dispensers typically include a reservoir for containing perfume which is in fluid communication with a seat in which the ball is rollably constrained. A portion of the ball protrudes through the seat and is pressed against a person's skin and rolled therealong to apply perfume from the reservoir.

Such dispensers typically include a spring which biases the roller ball into the seat. In use, the dispenser is tipped to cause the perfume to cover the seat and ball on the interior of the dispenser. When the ball is pressed against a person's skin, the ball is slightly unseated, thus creating space between the ball and the seat for the perfume to coat the ball and to flow onto the skin as it is applied. Such prior art dispensers are typically not designed to be placed in a horizontal position. In other words, if the dispenser is set on its side so that perfume covers the ball and seat on the interior of the dispenser, the perfume leaks from the dispenser between the ball and the seat. Most of the prior art dispensers include springs which may or may not prevent such leakage. One prior art device, disclosed in U.S. Pat. No. 1,977,414 to Testa, discloses a roller ball which is not spring biased; however, the roller ball is described as being "loosely confined" within washer members and would certainly leak if it was tipped on its side.

SUMMARY OF THE INVENTION

The present invention comprises an elongate dispenser for cologne or the like which includes a roller-ball applicator. A reservoir for holding perfume, cologne or the like is located adjacent the roller-ball applicator and provides perfume to the applicator when the dispenser is tipped. When the dispenser is placed in a horizontal position, means are provided for preventing perfume in the reservoir from reaching the roller-ball applicator.

It is a general object of the present invention to provide a dispenser for cologne or the like which overcomes the above-enumerated problems associated with prior art dispensers.

It is a more specific object of the present invention to provide such an apparatus which can be tipped for applying cologne or the like and can be placed in a horizontal position without leaking.

It is another specific object of the present invention to provide such an apparatus which can be placed in a horizontal position without leaking and which does not incorporate springs or other biasing means.

These and other objects and advantages of the present invention will become more fully apparent when the following detailed description is read in view of the accompanying drawings.

DETAILED DESCRIPTION OF THE PREFERRED EMBODIMENT

Figure 1:
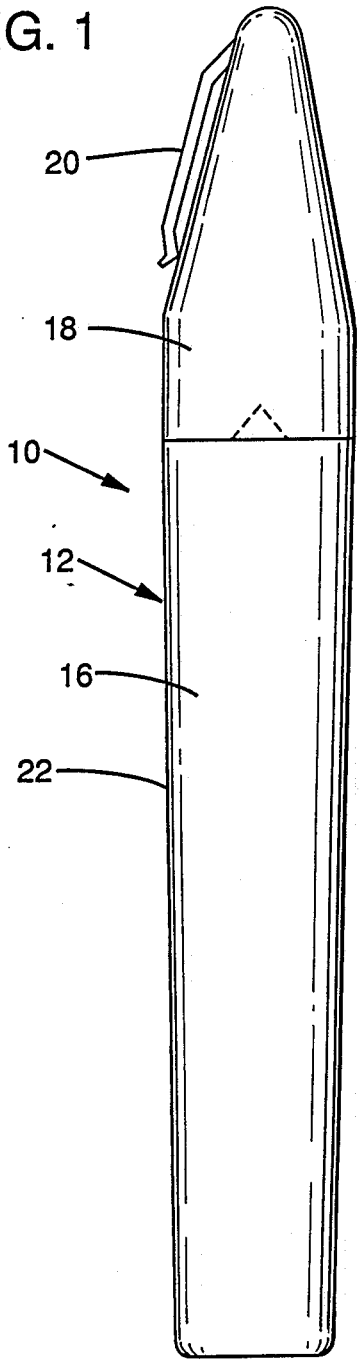
FIG. 1 is a cologne dispenser constructed in accordance with the present invention.
Figure 2:
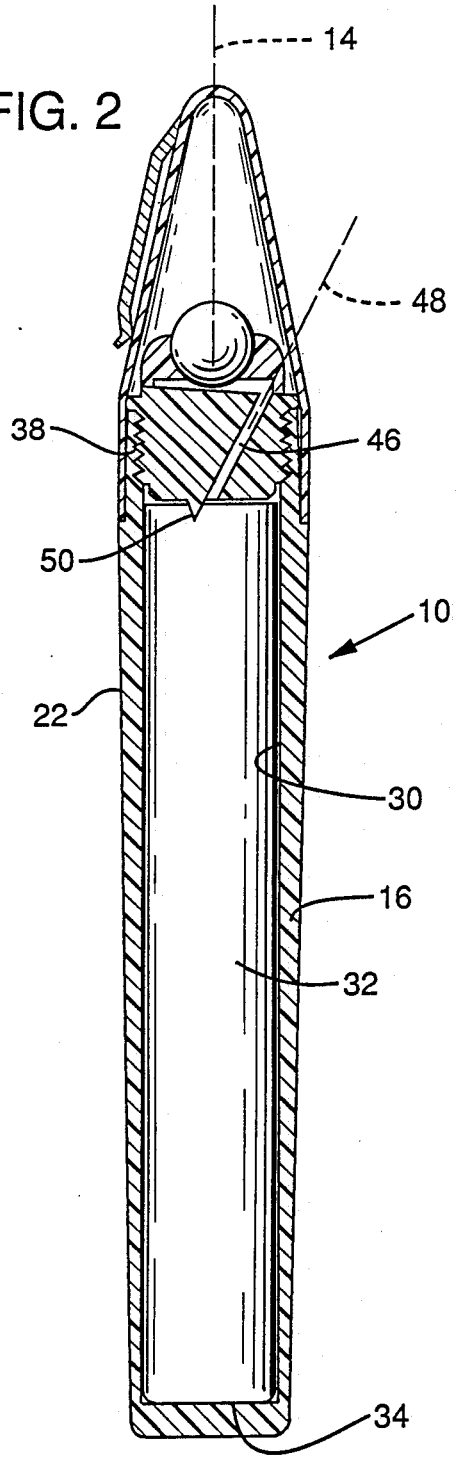
FIG. 2 is a cross-sectional view of the dispenser of FIG. 1.

Indicating generally at 10 in FIGS. 1 and 2 is a cologne dispenser constructed in accordance with the present invention.

Dispenser 10 includes an elongate case 12 having a longitudinal axis 14. Case 12 includes a case body 16, such body also being referred to herein as the case, and a cap 18. Cap 18 includes a clip 20, such also comprising a weight.

Figure 6:
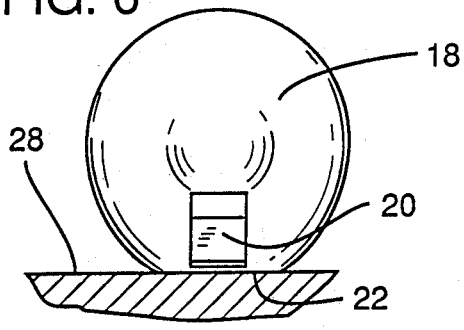
FIG. 6 is an end view of the dispenser in a horizontal position.

Case body 16 and the lower portion of cap 18 are generally cylindrical in shape; however, a flattened surface 22, best viewable in FIG. 6, is formed on one side of case body 16 and on the lower cylindrical portion of cap 18.

Figure 3:
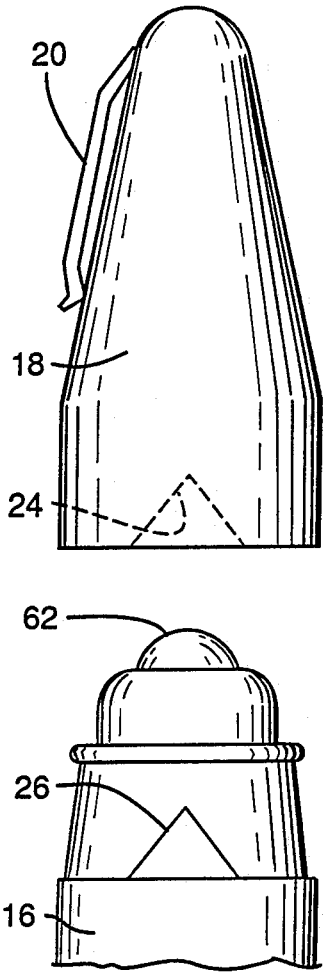
FIG. 3 is a slightly modified embodiment of the dispenser of FIGS. 1 and 2 shown with the cap thereof removed.

In FIG. 3, cap 18 includes a slot 24 formed on the interior of the cap while case body 16 includes a key 26 forming a radially outer surface thereof. Slot 24 and key 26 function to place the cap in a predetermined radial position relative to the case body when the cap is engaged with the body as shown in FIGS. 1 and 2.

Flattened surface 22 and weight or clip 20 are referred to herein as means for causing the case to rest on a predetermined side. As can be seen in FIG. 6, when dispenser 10 is placed on its side on a surface, like surface 28, flattened surface 22 prevents the case from rolling. In addition, even if the case is set on a cylindrical surface, rather than the flattened surface 22 of the case, weight 20 causes the case to roll onto flattened surface 22 thereby preventing further rolling.

A reservoir 30 formed in case body 16 contains a vial 32 of cologne. In the present embodiment of the invention, the vial contains 1/5 ounce of cologne. Vial 32 includes a lower end 34 which is supported by and adjacent the lower end of case body 16. The upper end of vial 32 is immediately beneath a set of radially inner threads 36 formed on cylindrical body 16.

A generally cylindrical plug 38 includes a set of threads 40 formed on the radially outer surface thereof. Threads 36, 40 are threadably engageable with one another and are shown fully engaged in FIG. 2. Plug 38 includes a first face 42 and a second face 44. A bore 46 provides fluid communication between the two faces. Bore 46 has a longitudinal axis 48 which, as can best be seen in FIG. 2, is at an angle relative to axis 14 of case 12. A sharpened portion or point 50 extends downwardly from face 44. When vial 32 is received in case body 16, plug 38 is completely threadably engaged with the case body (shown in FIG. 2) and point 50 punctures the top of vial 32 thus permitting cologne in the vial to flow into bore 46.

Plug 38 includes an annular shoulder 52 about the circumference thereof. When plug threads 40 are fully threadably engaged with plug threads 36, the lower surface of shoulder 52 abuts against a top annular surface 54 on case body 16, thereby preventing further rotation of the plug relative to body 16. Shoulder 52 and surface 54 are referred to herein as means for placing the plug in a predetermined radial position relative to the case. As is best viewed in FIG. 2, plug 38, when fully threadably engaged with the case body, is positioned so as to maximize the angle that axis 48 of bore 46 assumes relative to flattened surface 22 with the lower end of bore 46 being closer to the plane containing flattened surface 22 than the upper end of bore 46.

Indicated generally at 56 is an annular seat member, such being also referred to herein as a roller-ball applicator. The annular seat member includes an annular seat 57 having a front surface 58 and a rear surface 60. A ball 62 is rollably constrained in annular seat 57. The annular seat is fixedly mounted on the top surface of plug 38 and a space 64 is defined between surface 42 on the plug and surface 60 on annular seat 57.

Figure 4:
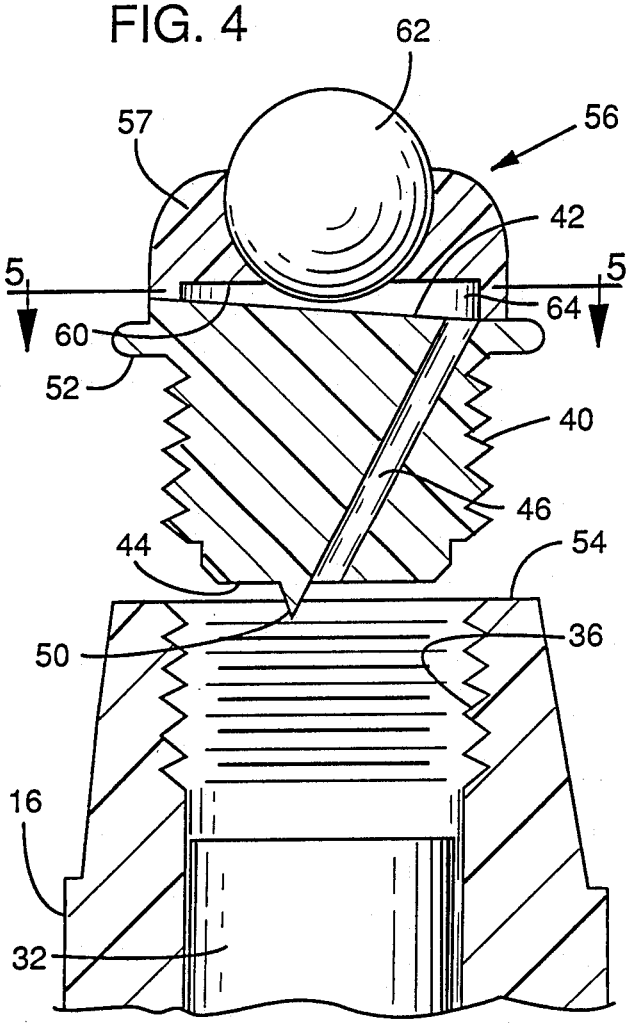
FIG. 4 is an enlarged exploded view of a portion of the view of FIG. 2.
Figure 5:
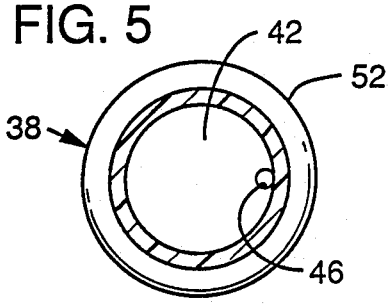
FIG. 5 is a view taken along line 5—5 of FIG. 4.

In operation, when it is desired to equip the dispenser with cologne, a vial, like vial 32, is lowered into case body 16 as shown in FIG. 4. Thereafter, plug 38 is threadably engaged with threads 36 on case body 16 until shoulder 52 abuts surface 54, thus preventing further rotation of the plug. When such occurs, the plug is positioned as shown in FIG. 2 and point 50 has punctured vial 32, thus providing fluid in the vial to the lower end of bore 46. Next, cap 18 is releasably secured to case body 16 with slot 24 engaged with key 26. When so assembled, the dispenser is configured as shown in FIG. 1. The dispenser may be worn inside a shirt pocket with clip 20 being used to clip the dispenser in the pocket in much the same way that an ink pen or the like is clipped inside a shirt pocket.

When it is desired to use dispenser 10 to apply cologne, the dispenser is removed from the pocket and cap 18 is removed from case body 16 as shown in FIG. 3. Thereafter, the dispenser is tipped so that cologne in vial 32 flows into bore 46 and communicates with that portion of ball 62 exposed to space 64. Ball 62 is then applied to the skin and rolled therealong, thus coating the ball with cologne in space 64 and transmitting the same between annular seat 57 and ball 62 to the skin along which the ball is rolled.

After the cologne is so applied, cap 18 is then resecured to body 16 and the dispenser is again clipped in the pocket. Since surface 42 on plug 38 is slanted toward bore 46, any fluid remaining in space 64 flows toward the bore and back down bore 46 toward vial 32.

When dispenser 10 is not carried in a pocket as described above, it will most likely be laid on its side on a flat surface, like surface 28 in FIG. 6. When dispenser 10 is laid on a curved surface of case body 16, the weight of clip 20 causes the dispenser to roll until the weight is directed downwardly, shown in FIG. 6, thus positioning the dispenser as shown in FIG. 6. As can be seen in the view of FIG. 2, when the dispenser is so positioned, the end of bore 46 which terminates at face 42 of the plug is higher than the top side of vial 32 thus preventing cologne flow from the vial to space 64.

This can be visualized by rotating FIG. 4 90° counterclockwise. The end of bore 46 which terminates at face 42 is now higher than the top side of vial 32. Thus, fluid cannot flow from the vial up bore 46 and into space 64. When there is no fluid in space 64, there can be no leakage between annular seat 57 and ball 62.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. An elongate dispenser for scented fluid comprising:

an annular seat member having a front surface and a rear surface and further having a ball rollably constrained therein with a portion of said ball being exposed to the rear surface and a portion exposed to the front surface;

a reservoir for holding scented fluid located along a common axis with said ball and positioned adjacent said rear seat surface and providing scented fluid to that portion of said ball exposed to the rear seat surface when the dispenser is tipped; and means defining an open channel between said ball and said reservoir not parallel with said common axis for preventing scented fluid in the reservoir from reaching that portion of said ball exposed to the rear seat surface when the dispenser is placed in a horizontal position.

2. A dispenser according to claim 1 wherein said dispenser further comprises:

an elongate case for containing said reservoir and having said seat member mounted on one end thereof; and means for causing said case to roll to rest on a predetermined side thereof when said case is set on its side.

3. A dispenser according to claim 2 wherein said case is substantially cylindrical in shape and wherein said means for causing said case to rest on a predetermined side thereof comprises a flattened surface formed on said predetermined side.

4. A dispenser according to claim 3 wherein said means for causing said case to rest on a predetermined side thereof further comprises a weight mounted on said predetermined side for rolling said case to said flattened surface when said case is set on a curved side thereof.

5. An elongate dispenser for scented fluid comprising:

an annular seat member having a front surface and a rear surface and further having a ball rollably constrained therein with a portion of said ball being exposed to the rear surface and a portion exposed to the front surface;

a reservoir for holding scented fluid positioned adjacent said rear seat surface and providing scented fluid to that portion of said ball exposed to the rear seat surface when the dispenser is tipped; and means for preventing scented fluid in the reservoir from reaching that portion of said ball exposed to the rear seat surface when the dispenser is placed in a horizontal position; and comprising a plug disposed between said reservoir and said rear seat surface, said plug having a bore formed therethrough for providing scented liquid to that portion of said ball exposed to the rear seat surface when the dispenser is tipped.

6. A dispenser according to claim 5 wherein the surface of said plug facing said rear seat surface is slanted toward the end of said plug bore for draining scented fluid into said bore when said dispenser is in an upright position.

7. A dispenser according to claim 5 wherein said dispenser further comprises an elongate case for containing said reservoir, said seat member being mounted on one end thereof and said plug bore axis assuming an angle relative to the case axis.

8. A dispenser according to claim 7 wherein said case is cylindrical in shape and includes a weight mounted on one side thereof for rolling said case into a position in which said plug bore drains scented fluid away from said rear seat surface when said case is set on a curved side thereof.

9. A dispenser according to claim 8 wherein said case includes a body and a cap engageable with said body, said weight being mounted on said cap, and said dispenser further includes means for placing said cap in a predetermined radial position relative to said case body when said cap is engaged therewith.

10. A dispenser according to claim 7 wherein said plug is threadably engaged with said case and wherein said plug further includes a sharp portion directed toward said reservoir for piercing a vial of scented fluid contained in said reservoir.

11. A dispenser according to claim 10 wherein said plug further includes means for placing said plug in a predetermined radial position relative to said case when said plug is fully threadably engaged with said case.

12. Apparatus for use in a dispenser for scented fluid of the type having an elongate cylindrical case, a roller-ball applicator mounted on one end of said case, said applicator being located along the central longitudinal axis of the case and a reservoir inside said case for providing scented fluid to the roller-ball applicator, said apparatus comprising:

a plug in said case disposed between said applicator and said reservoir and having a first face directed toward said applicator and a second face directed toward the reservoir;

a bore formed in said plug between the first and second faces for providing an open channel for said fluid from the reservoir to said applicator when said case is tipped and for draining fluid away from said applicator when said case is placed in an upright position, said bore having an angle relative to the longitudinal axis of said case which prevents fluid flow from the reservoir to said applicator when said case is set on a predetermined side thereof.

13. An apparatus according to claim 12 wherein said plug is threadably engaged with said case and wherein said plug further includes a sharp portion directed toward said reservoir for piercing a vial of scented fluid contained in said reservoir.

14. An apparatus according to claim 12 wherein said apparatus further includes means for placing said plug in a predetermined radial position relative to said case when said plug is fully threadably engaged with said case.

15. An apparatus according to claim 12 wherein said apparatus further includes means for causing said case to roll to rest on a predetermined side thereof when said case is set on its side.

16. An apparatus according to claim 15 wherein said means for causing said case to rest on a predetermined side thereof comprises a flattened surface formed on said predetermined side.

17. An apparatus according to claim 16 wherein said means for causing said case to rest on a predetermined side thereof further comprises a weight mounted on said predetermined side for rolling said case to said flattened surface when said case is set on a curved side thereof.

18. An apparatus according to claim 17 wherein said case includes a body and a cap engageable with said body, said weight being mounted on said cap, and said apparatus further includes means for placing said cap in a predetermined radial position relative to said case body when said cap is engaged therewith.

19. An elongate dispenser for scented liquids which comprises:

a ball rollably mounted on one end of said dispenser;

a reservoir for holding scented liquid and for providing said scented liquid to said ball;

an angled bore extending from said reservoir to said ball for feeding said scented liquid from said reservoir to said ball; and means to cause said dispenser to roll to a predetermined side so that said angled bore does not feed scented liquid to said ball.

20. Apparatus for use in a dispenser for scented fluid of the type having an elongate cylindrical case, a roller-ball applicator mounted on one end of said case and a reservoir inside said case for providing scented fluid to the roller-ball applicator, said apparatus comprising:

a plug in said case disposed between said applicator and said reservoir and having a first face directed toward said applicator and a second face directed toward the reservoir;

a bore formed in said plug between the first and second faces for providing an open channel for said fluid from the reservoir to said applicator when said case is tipped and for draining fluid away from said applicator when said case is placed in an upright position, said bore having an angle relative to the longitudinal axis of said case which prevents fluid flow from the reservoir to said applicator when said case is set on a predetermined side thereof; and said first plug face slanted toward the end of said plug bore which terminates at said first plug face for draining scented fluid into said bore when said case is in an upright position.

* * * * *